US006178574B1

(12) United States Patent
Stromatt et al.

(10) Patent No.: US 6,178,574 B1
(45) Date of Patent: Jan. 30, 2001

(54) BEDSHEET WITH POCKET

(76) Inventors: Jeff Stromatt; Melody Stromatt, both of 364 Solitude Cir., Goodlettsville, TN (US) 37072

( * ) Notice: Under 35 U.S.C. 154(b), the term of this patent shall be extended for 0 days.

(21) Appl. No.: 09/550,773

(22) Filed: Apr. 17, 2000

(51) Int. Cl.[7] ..... A47G 9/04
(52) U.S. Cl. ..... 5/485; 5/497
(58) Field of Search ..... 5/485, 482, 497, 5/495, 931, 639

(56) References Cited

U.S. PATENT DOCUMENTS

| | | | |
|---|---|---|---|
| 3,120,721 | 2/1964 | Bukatman et al. . | |
| 3,638,251 | 2/1972 | Weiss . | |
| 4,005,499 | 2/1977 | Klein . | |
| 4,064,576 | 12/1977 | Threatt . | |
| 4,627,123 | 12/1986 | Uggerud | 5/485 |
| 4,686,726 | 8/1987 | Dunfee | 5/485 |
| 4,688,286 | 8/1987 | Miker, Jr. | 5/485 |
| 5,279,009 | 1/1994 | Putka, Jr. | 5/485 |
| 5,438,719 | 8/1995 | Anthony | 5/485 |
| 5,443,880 * | 8/1995 | Wike | 5/485 |
| 5,557,814 | 9/1996 | Cybulski | 5/485 |
| 5,737,785 | 4/1998 | Casey | 5/485 |

FOREIGN PATENT DOCUMENTS

| | | | |
|---|---|---|---|
| 2198348 * | 6/1988 | (GB) | 5/485 |

* cited by examiner

*Primary Examiner*—Alexander Grosz
(74) *Attorney, Agent, or Firm*—Waddey & Patterson; Emily A. Shouse

(57) ABSTRACT

A bedsheet with pocket is made by forming a hidden pocket which is located between the bedsheet and a mattress. A slot opening is made in the side edge cover area of a bedsheet, preferably near the head edge cover area of the sheet. The open edge of the pocket is attached to the slot opening to form a cavity to hold articles such as television remote controls, medicines or tissues, within easy reach of a person in bed.

15 Claims, 2 Drawing Sheets

BEDSHEET WITH POCKET

BACKGROUND OF THE INVENTION

The present invention relates generally to bed linens and more particularly, this invention pertains to a bedsheet having a pocket to hold items within easy reach of a person in bed.

Most people have a number of items that they like to keep within arms reach of their bed. For example, tissues, glasses, a television remote control, medication and a flashlight can be found on many people's nightstands. However, it is easy to have so many items on the nightstand that a person must search for the particular item they want. Additionally, due to the size and configuration of the room, it is not always possible to have a nightstand immediately beside both sides of the bed. Thus, it is desirable to have a place to keep a few often used items in an easily accessible location as close to the bed as possible. Several patents have been directed toward linens with pockets as outlined below.

U.S. Pat. No. 3,120,721 teaches a bedspread having toy devices integrated with the bedspread, including pockets for holding toys on the side of the foot of the bed. However, the location of these pockets does not make them easy to reach while lying in bed. Additionally, the nature of this bedspread is such that it is not desirable for adults. It would be easy for items to fall out of the pockets during the night, possibly resulting in damage to the items.

U.S. Pat. No. 4,005,499 teaches a bed sheet or blanket in which the two halves of the covering are removably detachable so that each can be used or cleaned separately. Each half includes a pocket, designated 15, for holding a treated piece of material or sachet with perfume or medicine. These pockets are not appropriate for holding remote controls or the like as the item would be on top of the person in bed.

U.S. Pat. No. 5,279,009 teaches a bedsheet with storage pockets affixed to the outside of the sides of a sheet. This invention contemplates a pocket having a closure means such as a zipper and a flap to cover the closure means and is intended to provide secure storage for a gun or other personal security device. Because the pocket is attached to the outside of a sheet, it is bulky even when empty.

U.S. Pat. No. 5,737,785 teaches a blanket with pockets for storing loose items at the beach or swimming pool.

What is needed, then, is a bedsheet having an integrated or hidden pocket that will hold articles within easy reach of a person in bed in such a way that the articles stay in the pocket without falling out if the person moves in bed.

SUMMARY OF THE INVENTION

In the bedsheet of the present invention, a bedsheet with pocket is made by forming a hidden pocket or pouch which is located between the bedsheet and a mattress. A slot opening is made in the side edge cover area of a bedsheet, preferably near the head edge cover area of the sheet. The open edge of a pocket is attached to the slot opening to form a cavity to hold articles such as television remote controls, medicines or tissues within easy reach of a person in bed. The location of the pocket within the bedsheet itself provides several advantages, including preventing a bulky appearance when a bedspread or other bed covering is on the bed. The bedsheet pocket is easy to maintain and can be laundered in the same manner as a conventional bedsheet without a pocket.

Accordingly, it is an object of this invention to provide a convenient way to store items that might be needed by a person in bed.

It is a further object of the present invention to provide a storage means that does not require use of a bedside table.

It is a further object of the present invention to provide a pocket which is integrated with a bedsheet.

It is a further object of the present invention to provide a hidden pocket in a bedsheet.

It is a further object of the present invention to provide easy and quick access to items from the bed.

It is a further object of the present invention to provide a bedsheet pocket which is easily maintained and does not require special care.

It is a further object of the present invention to provide a hidden storage means which is not bulky.

DESCRIPTION OF THE PREFERRED EMBODIMENTS

Figure 1:
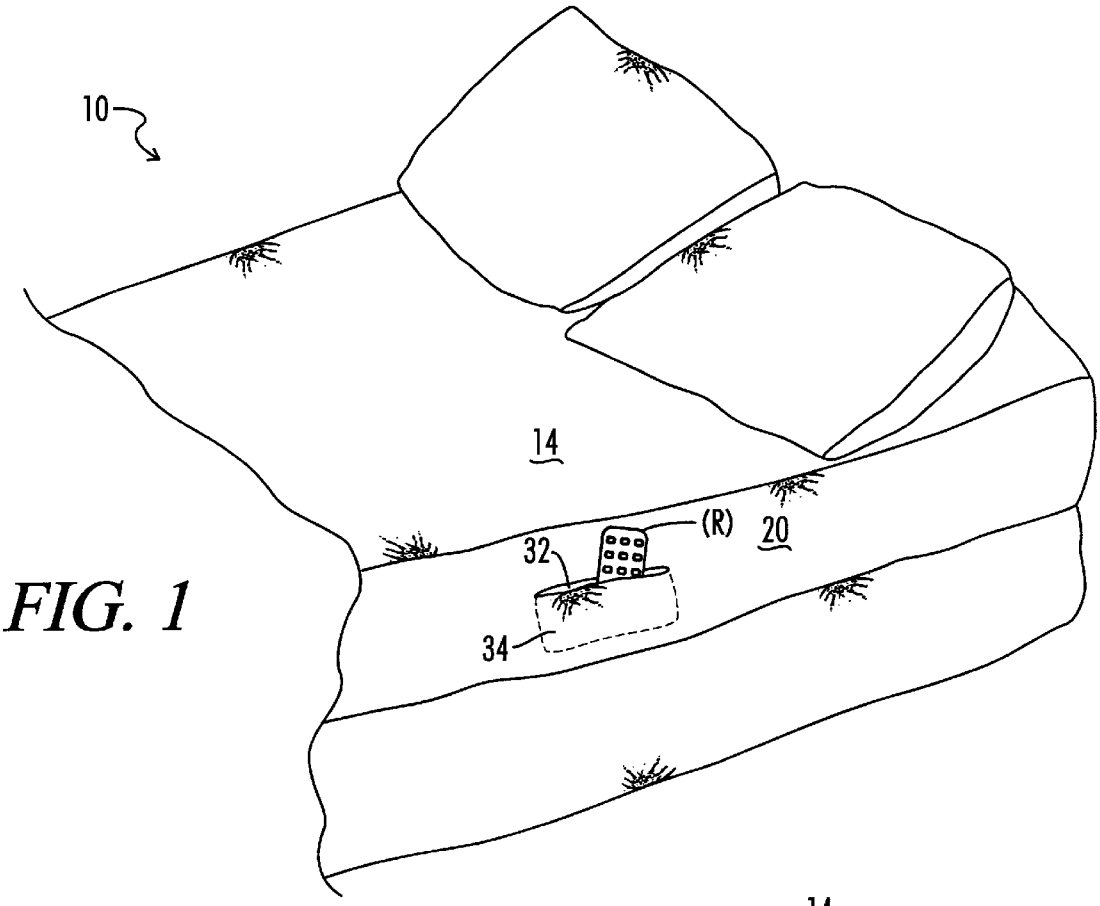
FIG. 1 is a perspective view of the present invention.

Looking at FIG. 1, a bedsheet with pocket of the present invention is designated generally as 10. This figure shows the invention in position on a mattress with a remote control (R) inserted in the pocket.

Figure 2:
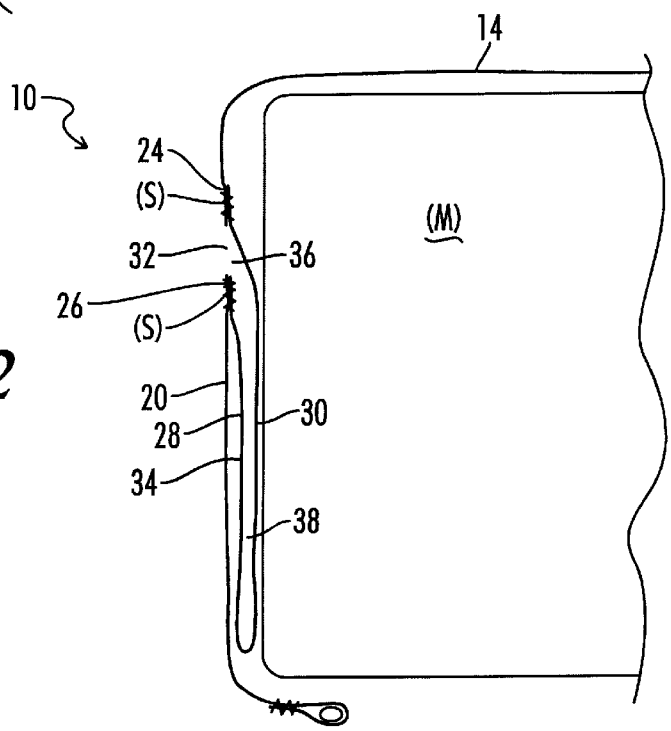
FIG. 2 is a side view of the cut-away view of the present invention.
Figure 3:
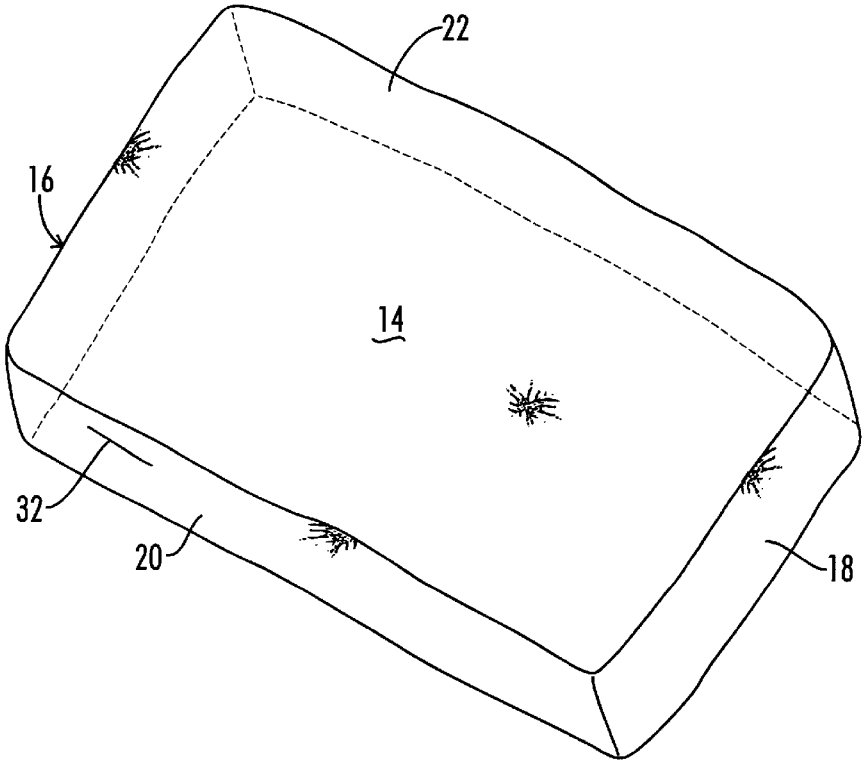
FIG. 3 is a perspective view of the present invention.

FIG. 2 shows a side cutaway view of the bedsheet 10, or rectangular-shaped fabric sheet 10, on a mattress (M). The bedsheet 10 has a surface cover area 14 or main portion 14, a head side edge cover area 16 or head edge portion 16, a foot side edge cover area 18 or foot edge portion 18, a first side edge cover area 20 or first side edge portion 20, and a second side edge cover area 22 or second side edge portion 22, wherein the surface cover area 14 covers the part of the mattress which a person lies on, and the side edge cover areas correspond to a side edge of the mattress (M). Slot opening 32, also known as slit 32, having a first lip 24 and a second lip 26, is formed in first side edge cover area 20. Pocket 34 has a front surface 28 and a back surface 30 fixedly secured to one another along three edges with the fourth or open edge remaining unsecured to provide an access opening 36 into a cavity 38 formed by front surface 28 and back surface 30. Pocket 34 might also be constructed of a single piece of material, shaped like a sock, or in any other manner known to one of skill in the art. Pocket 34 is attached to bedsheet 10 at slot opening 32 such that when the bedsheet 10 is positioned on mattress (M), a hidden pocket 34 is formed where pocket 34 is between mattress (M) and bedsheet 10.

Figure 4:
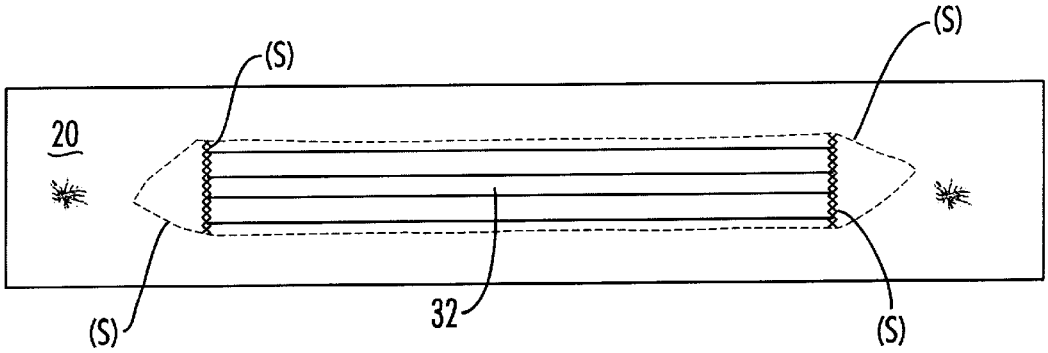
FIG. 4 is a view of the slot opening of the present invention.

Further shown in FIG. 2, pocket 34 is attached to slot opening 32 by first lip 24 of slot opening 32 attaching to back surface 30 of pocket 34 at access opening 36 and second lip 26 of slot opening 32 attaching to front surface 28 of pocket 34 at access opening 36. Attachment is accomplished by stitching (S) in the preferred embodiment shown in FIGS. 2 and 4, but may be accomplished by any means known to one of skill in the art. It is also contemplated that a second pocket (not shown) could be attached to a second slot opening or slit in a second side edge cover area 22 in a similar arrangement. Furthermore, in the preferred embodiment, pocket 34 is joined to bedsheet 10 on first side edge cover area 20 proximate the head edge cover area 16, thus positioning pocket 34 in a convenient position for a person in bed. A second pocket could also be similarly positioned proximate the head edge cover area 16 in the second side edge cover area 22.

It is also contemplated that a releasable fastener means (not shown) could be used to releasably join front surface 28 and back surface 30 of pocket 34 for selective closure of pocket 34. Releasable fastener means could include a zipper, hook and loop closure, snap, or button and hole, or any other means known to one of skill in the art.

Although the preferred embodiment of bedsheet 10 is a fitted sheet, it is contemplated that a flat sheet could also be utilized.

Thus, although there have been described particular embodiments of the present invention of a new and useful Bedsheet Pocket, it is not intended that such references be construed as limitations upon the scope of this invention except as set forth in the following claims.

What is claimed is:

1. An integrated bedsheet and pocket for use on a bed mattress comprising:

a bedsheet having a surface cover area and a head, foot, first side and second side edge cover areas constructed for application over the top surface and the head, foot, first side and second side edges of a bed mattress;

a slot opening formed in said first side edge cover area, said slot opening having a first lip and a second lip; and a pocket having a front surface and a back surface fixedly secured to one another along three edges, a fourth edge remaining unsecured to provide an access opening into a cavity formed by said front and back surfaces;

wherein said pocket is attached to said slot opening in said first side edge cover area of said bedsheet such that said pocket is located between said bedsheet and a bed mattress when said bedsheet is positioned on a bed mattress.

2. The device of claim 1 wherein said fourth edge of said front surface is attached to said first lip of said slot opening and said fourth edge of said back surface is attached to said second lip of said slot opening such that items can be put through said slot opening and said first lip and said second lip and held in the cavity of said pocket.

3. The device of claim 1 further comprising a second slot opening formed in said second side edge cover area and a second pocket attached to said second slot opening.

4. The device of claim 1 wherein said slot opening formed in said first side edge cover area is proximate said head edge cover area.

5. The device of claim 3 wherein said second slot opening formed in said second side edge cover area is proximate said head edge cover area.

6. The device of claim 1 further including a releasable fastener means to releasably join said fourth edge of said front surface and said fourth edge of said back surface for selective closure of said pocket.

7. The device of claim 6 wherein said releasable fastener is a zipper.

8. The device of claim 6 wherein said releasable fastener is hook and loop closure.

9. The device of claim 1 wherein said bedsheet is a fitted sheet.

10. The device of claim 1 wherein said bedsheet is a flat sheet.

11. A fitted bedsheet with pocket for use with a mattress comprising: a rectangular-shaped fabric sheet having a main portion which fits the top surface of a mattress, a head edge portion which fits the edge of the head of a mattress, a foot edge portion which fits the edge of the foot of a mattress, a first side edge portion which fits one edge of the side of a mattress, a second side edge portion which fits the opposite side edge of a mattress;

a slit in the first side edge portion of the sheet; and a pocket having an open edge;

wherein the open edge is attached to the slit to form a compartment in the sheet to hold articles, whereby when said bedsheet is positioned on a mattress, the pocket is located between the mattress and the bedsheet.

12. The device of claim 11 wherein the pocket is hidden.

13. The device of claim 11 wherein the slit is formed in the first side edge portion proximate the head of a mattress.

14. The device of claim 11 further comprising:

a second slit in the second side edge portion of the sheet; and a second pocket having a second opening;

wherein the second opening is attached to the second slit to form a compartment in the sheet to hold articles.

15. A fitted bedsheet with pocket for use with a mattress comprising: a rectangular-shaped fabric sheet having a main portion which fits the top surface of a mattress, a head edge portion which fits the edge of the head of a mattress, a foot edge portion which fits the edge of the foot of a mattress, a first side edge portion which fits one edge of the side of a mattress, a second side edge portion which fits the opposite side edge of a mattress;

a slot opening in the first side edge portion; and a sock-shaped pocket having an open edge;

wherein the open edge of the sock-shaped pocket is attached to a slot opening in the first side edge portion to form a hidden pocket, whereby when said bedsheet is positioned on a mattress, the pocket is located between the mattress and the bedsheet.

* * * * *